US008011413B2

(12) United States Patent
Poppema

(10) Patent No.: US 8,011,413 B2
(45) Date of Patent: Sep. 6, 2011

(54) RETRACTABLE SCREEN DOOR HOUSING HANDLE BALANCING SYSTEM

(75) Inventor: John Poppema, Langley (CA)

(73) Assignee: Screenline Innovations, Inc., Aldergrove (CA)

( * ) Notice: Subject to any disclaimer, the term of this patent is extended or adjusted under 35 U.S.C. 154(b) by 478 days.

(21) Appl. No.: 11/424,335

(22) Filed: Jun. 15, 2006

(65) Prior Publication Data

US 2006/0283564 A1 Dec. 21, 2006

Related U.S. Application Data

(60) Provisional application No. 60/691,439, filed on Jun. 16, 2005.

(51) Int. Cl.
*E06B 9/08* (2006.01)

(52) U.S. Cl. ..... 160/23.1; 160/31

(58) Field of Classification Search ..... 160/23.1, 160/84.06, 170, 172 V, 267.1, 191, 192, 265, 160/31; 16/198, 401
See application file for complete search history.

(56) References Cited

U.S. PATENT DOCUMENTS

| | | | | |
|---|---|---|---|---|
| 0,490,448 | A | | 1/1893 | Lugrin |
| 1,246,410 | A | | 11/1917 | Foley |
| 1,303,678 | A | | 5/1919 | Joseph |
| 2,243,771 | A | | 5/1941 | Nye |
| 3,146,825 | A | * | 9/1964 | Briggs, Jr. et al. ..... 160/191 |
| 3,759,568 | A | | 9/1973 | Unruh |
| 4,760,622 | A | * | 8/1988 | Rohrman ..... 16/196 |
| 5,280,818 | A | * | 1/1994 | Ubelhart ..... 160/265 |
| 5,299,617 | A | | 4/1994 | Hying et al. |
| 5,477,904 | A | * | 12/1995 | Yang ..... 160/370.23 |
| 5,479,979 | A | | 1/1996 | Hayashiguchi |
| 5,533,559 | A | * | 7/1996 | Judkins ..... 160/84.06 |
| 6,079,472 | A | | 6/2000 | Schanz |
| 6,082,432 | A | | 7/2000 | Kissinger |
| 6,111,694 | A | * | 8/2000 | Shopp ..... 359/461 |
| 6,463,983 | B1 | | 10/2002 | Lang |
| 6,478,070 | B2 | | 11/2002 | Poppema |
| 6,615,894 | B1 | | 9/2003 | McKeon |
| 6,629,555 | B2 | | 10/2003 | DeBlock et al. |
| 6,766,847 | B1 | * | 7/2004 | Wang ..... 160/199 |
| 6,805,187 | B2 | * | 10/2004 | Padiak et al. ..... 160/330 |
| 6,814,127 | B2 | | 11/2004 | Tagtow et al. |
| 7,234,502 | B2 | * | 6/2007 | O'Malley ..... 160/191 |
| 7,398,815 | B2 | * | 7/2008 | Liang ..... 160/170 |
| 7,487,817 | B2 | * | 2/2009 | Liang ..... 160/170 |
| 2007/0119547 | A1 | * | 5/2007 | Liang ..... 160/170 |
| 2007/0125505 | A1 | * | 6/2007 | Liang ..... 160/170 |

* cited by examiner

*Primary Examiner* — Blair M. Johnson
(74) *Attorney, Agent, or Firm* — Michael F. Hughes; Hughes Law Firm, PLLC

(57) ABSTRACT

A horizontally extending screen door system having balancing cords that pull in a direction that opposes the force on a handle by the screen exerted by the wind up mechanism of the screen.

5 Claims, 17 Drawing Sheets

68
66
64
54
106
72
110
70
62
108
50
104
102
60

98
100
50
96
55
78
90
76
80
84
88
88
94
52

FIG. 22
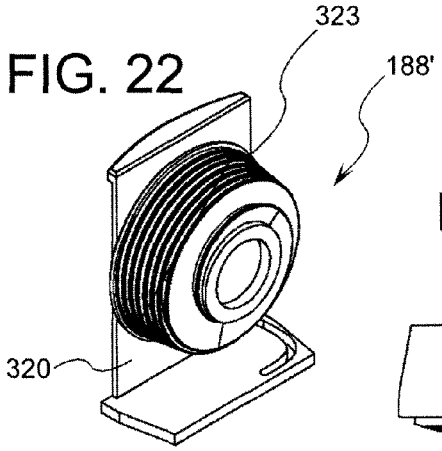
FIG. 23
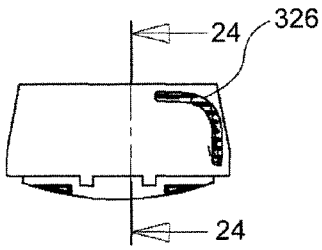
FIG. 24
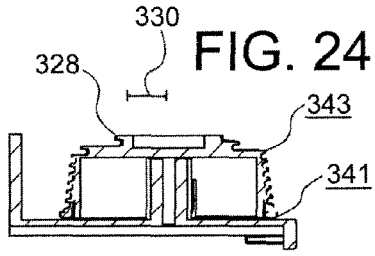
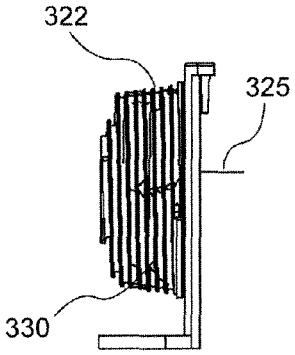
FIG. 25
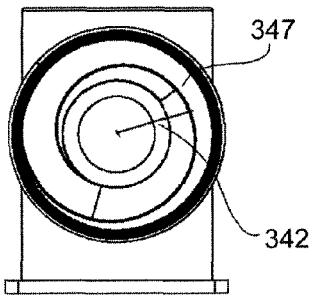
FIG. 26
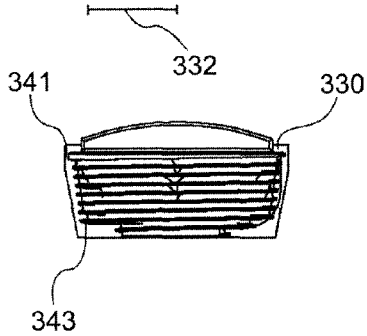
FIG. 27

RETRACTABLE SCREEN DOOR HOUSING HANDLE BALANCING SYSTEM

RELATED APPLICATIONS

This application claims priority benefit of U.S. Ser. No. 60/691,439, filed Jun. 16, 2005.

BACKGROUND

Screen doors fitted to the perimeter regions of windows and doors have long been a commodity in households as well as businesses. Certain types of screen doors that have upper and lower track members and some form of a housing generally attempt to lock in a screen door handle in some fashion in an open position where the screen is withdrawn. One form in the prior art of locking such a screen is to lock a handle in the upper and lower portions along a guide rail. However, the handle which is adapted to extend the screen from some form of the base housing is not well adapted to address any form of moment (torque) about a transverse axis. In other words, there is tremendous possibility for a handle to rotate about an axis orthogonal to the plane of the screen thereby having a "cock-eyed" handle with respect to the stationary frame items. This problem is amplified in situations where the screen places a tension in a first direction upon the handle and some form of lateral force in the second lateral direction must withstand this tension to keep the screen open. Further, it is desirable to have the screen shut and have some form of a spring to wind up the screen within a housing in a stored position.

One particular problem with repositioning a screen from an open position to a closed position is trying to finesse an equal amount of force to counteract the "holding force" to position the handle and screen in an open orientation with the screen extended. Normally the holding force is some sort of fractional engagement or temporary locking engagement such as extending some sort of knob around a constructed portion where the constructed portion slightly expands to have the knob extension fit therein. Of course this generic description can address a plurality of types of prior art mounting systems but the gist of such a mechanical apparatus requires some form of deformation of material to lock and unlock the handle to and from the open position. This generally requires perhaps some form of inertia or at least a focused amount of force with holding the handle in such an open position.

In other words, when opening a handle in prior art forms, there is some form of snapping action to lock such a handle open to counteract the force of the spring winding up a screen. It has been found to be problematic that when trying to close the screen, one of the two locking members at the upper lower portions will disengage while the other locking member remains engaged, causing the cockeyed arrangement of the handle which is very undesirable. Further, given the constraints of the ability to place reinforcement members to prevent such a situation, there appears to be little hope for preventing such misalignments of the handle from occurring. Further, once the handle is past the high resistance on any locking portion, there is essentially a lengthy free pull where the tension in the spring can translate the force there along the screen and the handle accelerates until slamming up to the base housing. Such an impact can cause injury to toes and fingers as well as cause general wear and tear on the screen assembly and possibly cause damage thereto.

Therefore, it is desirable to provide a system where a handle can remain open or even at intermediate locations where a counterbalancing force will occur at a plurality of locations and not just at an extreme open location. Such a system is desirable to allow for intermediate positioning of the handle, preventing a slamming action of the handle and to further aid in preventing any cockeyed arrangement of the handle with respect to the upper lower housing members.

SUMMARY OF DISCLOSURE

With the foregoing background in mind, it can be appreciated that providing an extractable handle horizontal balancing system is very desirable where a handle horizontal balancing system is adapted to be fitted to an upper guide member and lower guide member. Essentially, in one form the balancing system comprises a balancing cord and first and second ends attached to second lateral portions of upper lower guide members. There is a stationary pulley assembly within the handle as well as a movable pulley assembly where the movable pulley assembly has positional tension applied thereto. In other words, the movable pulley assembly is biased to move in a certain direction. The balancing cord extends around the pulley in a block and tackle like fashion and further extends around the upper and lower extremity portions of the handle thereby extending along the upper and lower guide members to the end portions where they are fixed thereto. The arrangement is such that when the handle has been repositioned to a closed position and the screen is beginning in the wound up, the pulleys will reposition towards one another and a biasing member will extend, resisting such movement. In other words, the balancing cord will place a tension that opposes the tension of the screen. Of course there are various other features and components of assemblies and systems which are described further herein in detail.

In general, the handle horizontal balancing system is adapted to place a force upon the handle housing in a first lateral direction as indicated by the lateral axis. Having a substantially relatively long handle housing to accommodate the passageway presents a challenge to provide stability to the handle housing so it does not rotate about a transverse axis. This challenge is presented because one can appreciate that given the nature of the retractable screen door in one orientation has a closed position where the handle is positioned in the first lateral portion whereby the screen is closed and retracted within the screen retraction system. Further, in operation, the retractable screen door assembly has an extended position whereby the handle housing is extended in the second lateral direction towards the perimeter portion to fully extend the screen.

The nature of attaching the handle housing to the upper and lower guide/bracketing members, is to provide a relatively compact system whereby in general there is not much capability of structurally providing supports in the upper and lower portions of the handle housing to the upper and lower guide members. In other words, general principles of fundamental mechanical engineering indicates that it is difficult to handle a moment about a transverse axis at the connection points between the handle housing and the guide members. To keep the handle housing in an open position, the handle housing locks somehow to some structural portion in the second lateral direction away from the base housing. In one form, with a system that does not provide any structure between the upper and lower guide members in the second lateral region, only provides attachment at the upper and lower portions of the handle housing. Therefore, providing a locking system which maintains a lateral resistance from the pull of the retractable-screen has traditionally been found to be a challenge. By locking the handle housing to both the upper and lower guide members in the open position, an issue arises were when retracting the screen door; one of the locking portions will engage and the other will disengage thereby creating a "cockeyed" arrangement where the handle housing is skewed and essentially rotates about a transverse axis.

Therefore, by providing a horizontal force in the lateral direction to balance out the handle housing, a very desirable situation is created where the handle housing is substantially balanced from the pull of the balancing cord and a counter-acting pull by the handle horizontal balancing system.

BRIEF DESCRIPTION OF THE DRAWINGS

FIG. 22 shows another embodiment of a biasing member, which in this form is a partial constant force spring;

FIG. 23 shows a bottom view of the biasing member FIG. 24 is taken at line 24-24 of FIG. 23 showing a cross-sectional wind-up spool;

FIG. 25 is a front view of the unit of the biasing member;

FIGS. 26 and 27 are side and top views of the wind-up spool.

DESCRIPTION OF THE EMBODIMENTS

Throughout this description reference is made to top and bottom, front and rear. The apparatus of the present invention can, and will in practice, be in numerous positions and orientations. These orientation terms, such as top and bottom, are obviously used for aiding the description and are not intended to limit the invention to any specific orientation. Specifically, the retractable screen door assembly 20 can be mounted to either the left or right side of a door opening there for the screen retaining and dispensing component 26 will be employed with the ratcheting region at either the upper or lower locations.

In the following text, there will first be a description of the overall operations of the apparatus of the present invention followed by a detailed description of the preferred embodiment of the present invention.

Figure 1:
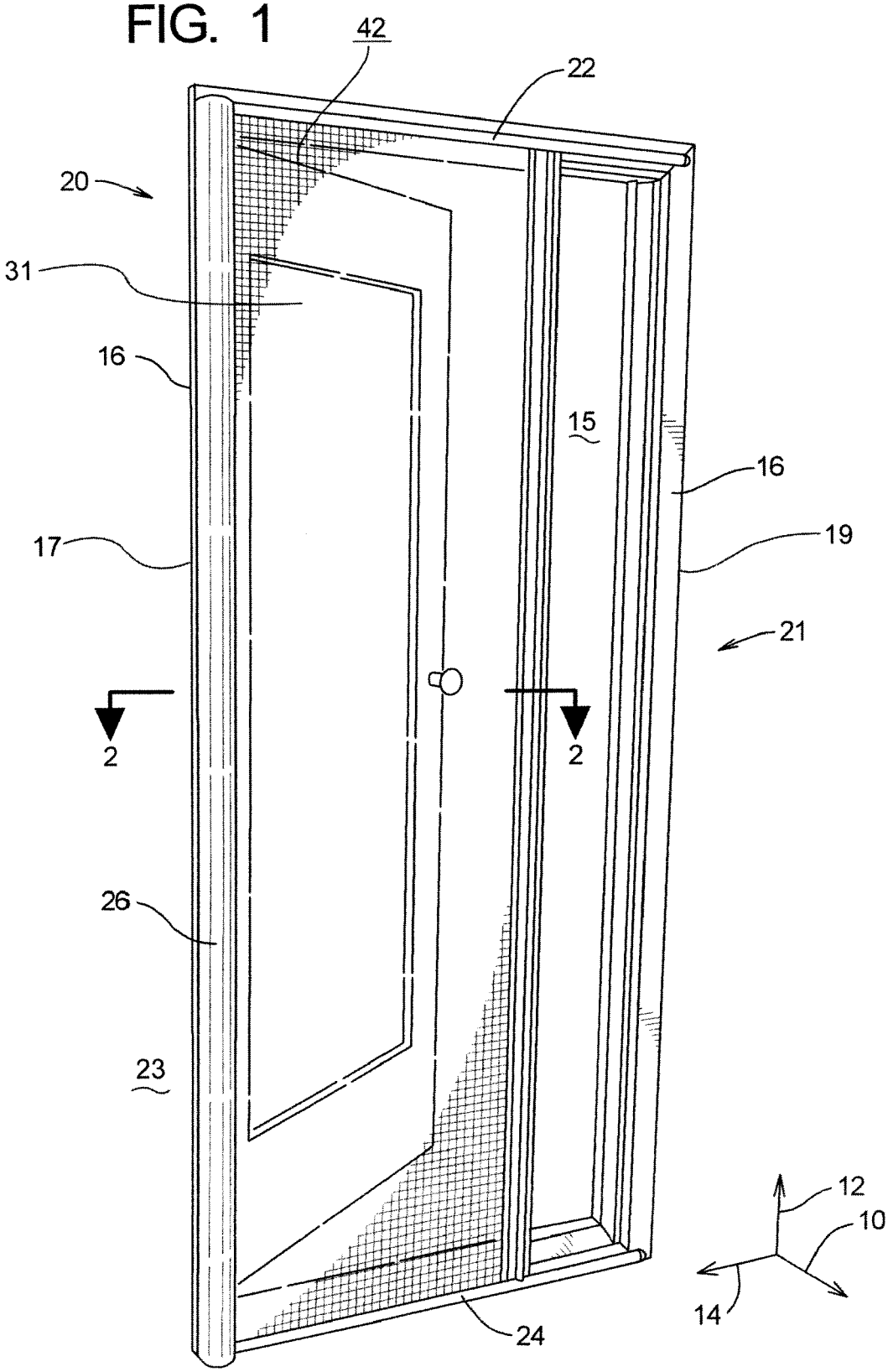
FIG. 1 is an isometric view of the screen door system.

To aid the description orthogonal directions are defined shown in FIG. 1, where axis 10 indicates a transverse direction, axis 12 indicates a vertical direction, and axis 14 indicates the lateral direction. The direction of the arrow in axis 10 is referred to as an "outward" direction on the transverse axis with a diametrically opposed direction is herein referred to as the "rearward" direction.

The apparatus of the present invention is a slidable door system that can be mounted to any number of doorframes and exterior sills. The apparatus is particularly advantageous for screen doors.

The apparatus 20 of the present invention is a retractable screen door assembly (designated 20) which in turn comprises a perimeter mounting frame 21, and a retractable screen 42 which, as its name suggests, has a retracted position where it is rolled up and located within a lateral portion 16 of the perimeter mounting frame 21, and an extended position where it has been pulled outwardly from the frame and extends across the open area within the perimeter of the mounting frame. In the preferred embodiment shown herein, the retractable screen door assembly 20 is shown as a retractable screen assembly for a doorway. However, it is to be understood that the basic design of the present invention could be used in other applications, such as providing a retractable screen assembly for a window, and different types of doorways or other access openings for homes, buildings, etc. In general, the environment of the retractable screen door assembly 20 comprises a passageway 15 positioned on some form of a building 23 such as a dwelling or commercial establishment, the passageway containing the first and the second perimeter regions 17 and 19. The passageway further comprises an upper perimeter portion and a lower perimeter portion. Further, the passageway 15 in most forms comprises a door 31 which normally is a hinged door or, in certain embodiments, a French double door. Of course, the retractable screen door assembly 20 is adapted to operate and retrofit to a plurality of types of passageways 15 but provides particular advantages of allowing a relatively discreet screen door which is desirable in many climates allowing air passage therethrough while blocking insects and vermin from entering the building 23.

The perimeter mounting frame 21 in turn comprises upper and lower laterally aligned bracketing components 22 and 24 located at the upper and lower locations, respectively, of the doorway or other opening, and a substantially vertical screen retaining and dispensing component 26.

The main function of the screen retaining and dispensing component 26 is to contain the retractable screen 42 in a rolled up retracted position and enable the screen to be extended therefrom, and the main function of the upper and lower laterally aligned bracketing components 22 and 24 is to provide upper and lower slide-ways along which the upper and lower edge portions of the retractable screen 42 can be guided as the retractable screen 42 moves between its retracted position and its extended position, and also to retain the retractable screen 42 in its extended position.

Figure 2:
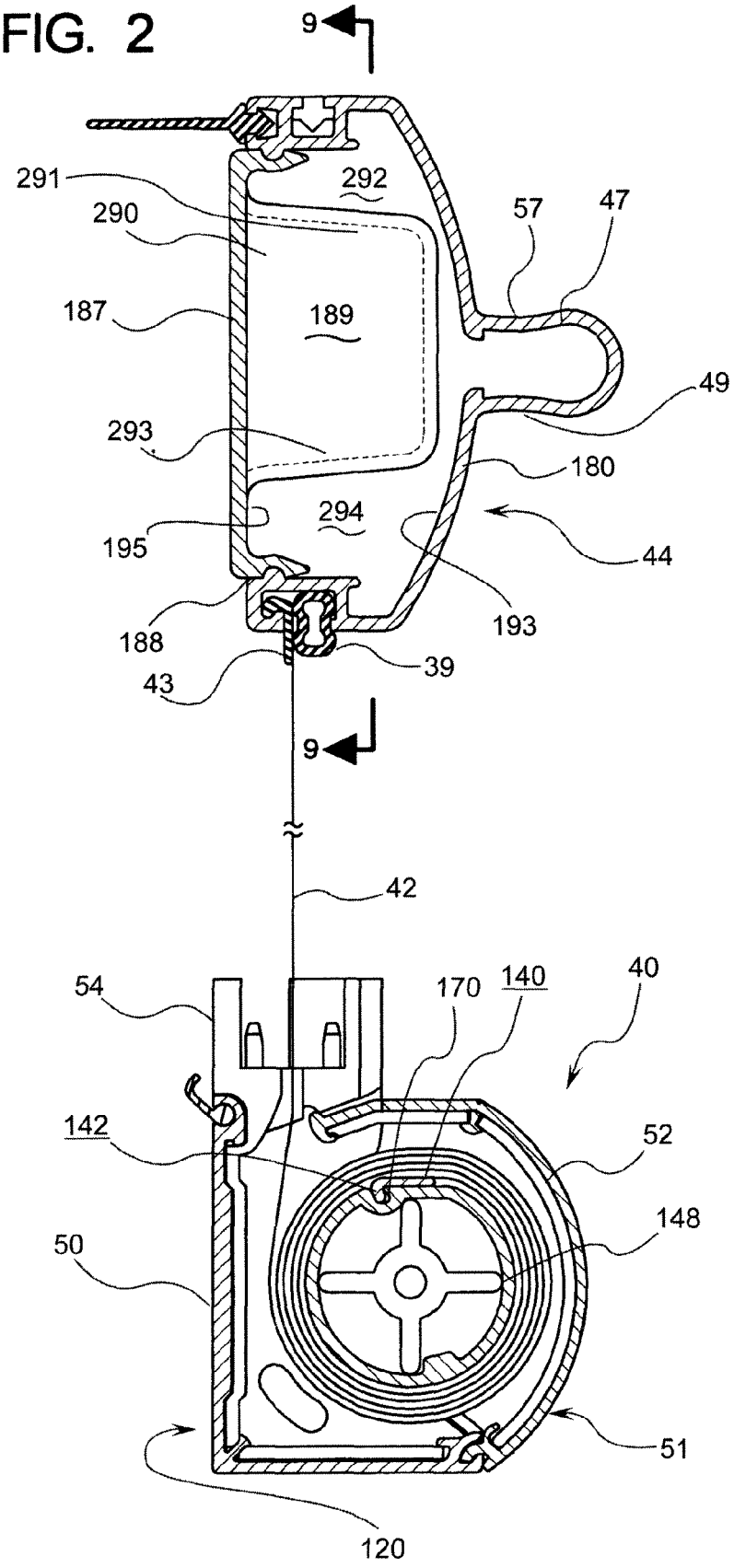
FIG. 2 is taken along line 2-2 of FIG. 1 showing in cross-sectional view the handle and the base housing.

Now referring to FIG. 2, there is shown a sectional view taken at line 2-2 of FIG. 1 showing the screen dispenser 40, the retractable screen 42, and the handle 44. The handle 44 will be discussed in detail where a block and tackle assembly is positioned therein to provide a counteracting force upon the handle to substantially balance the pulling force from the retractable screen 42. The balancing cord retraction system 120 will be discussed further below with reference to FIG. 7.

In general, the screen dispenser 40 comprises the base shell 50, the outer shell 52, a lower end cap shown in FIG. 2 as 54, and an upper end cap that is of a similar construction of the lower end cap which are both adapted to receive the upper and lower laterally aligned bracketing components 22 and 24 described herein. Of course, the construction of the lower and upper caps can be a variety of sorts to properly provide an upper and lower bracketing component to extend in the lateral direction.

Figure 3:
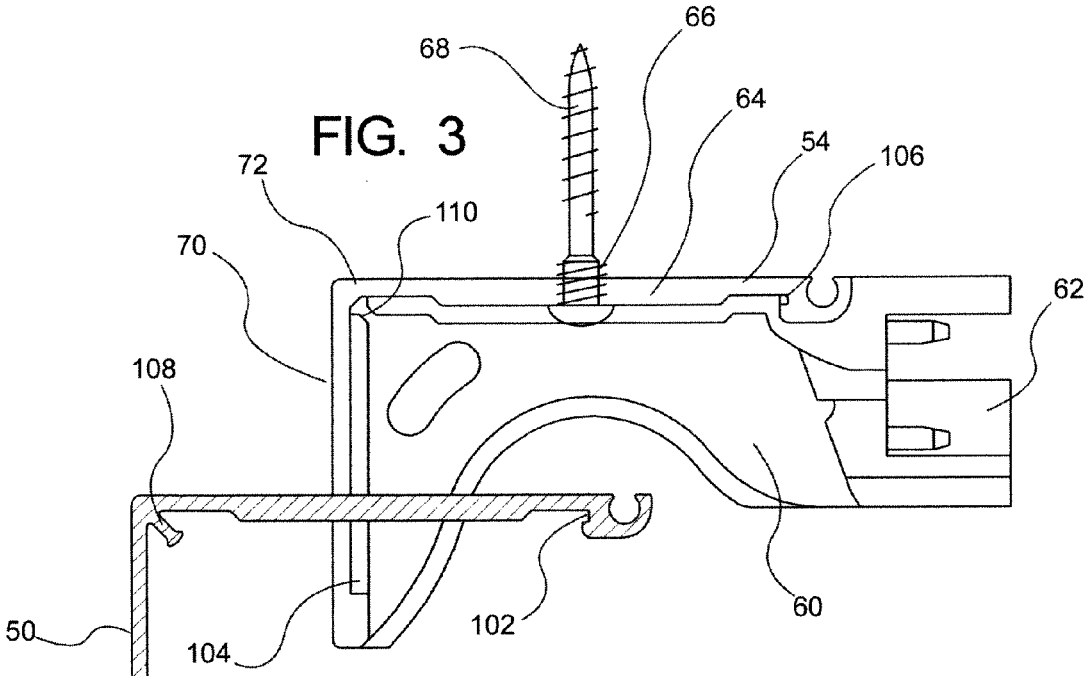
FIG. 3 shows the base shell portion of the base housing mounted to the lower base where a double-threaded screw is extended through the base shell, and set apart from the lower base region is the L-shaped base shell set aside illustrating how the L-shaped base shell fits to the lower base.

As shown in FIG. 3, the lower end cap 54 comprises a lower base region 60 and a bracket-receiving portion 62. The rear wall of the base shell 50 provides a surface to allow an opening 66 for a dual-threaded screw 68 to pass therethrough. The concept of the dual-headed screw is thoroughly discussed in the application by the same inventor for U.S. Pat. No. 6,478,070 which is fully incorporated by reference. The lateral portion 70 extends in the transverse direction, and the rear wall 64 and lateral portion 70 define a recessed region 72 to mount the base shell 50 thereto. FIG. 3 shows the base shell 50 slightly displaced from the lower end cap 54, whereas FIG. 4 shows the base shell 50 positioned thereabove in a locked-in configuration.

Figure 4:
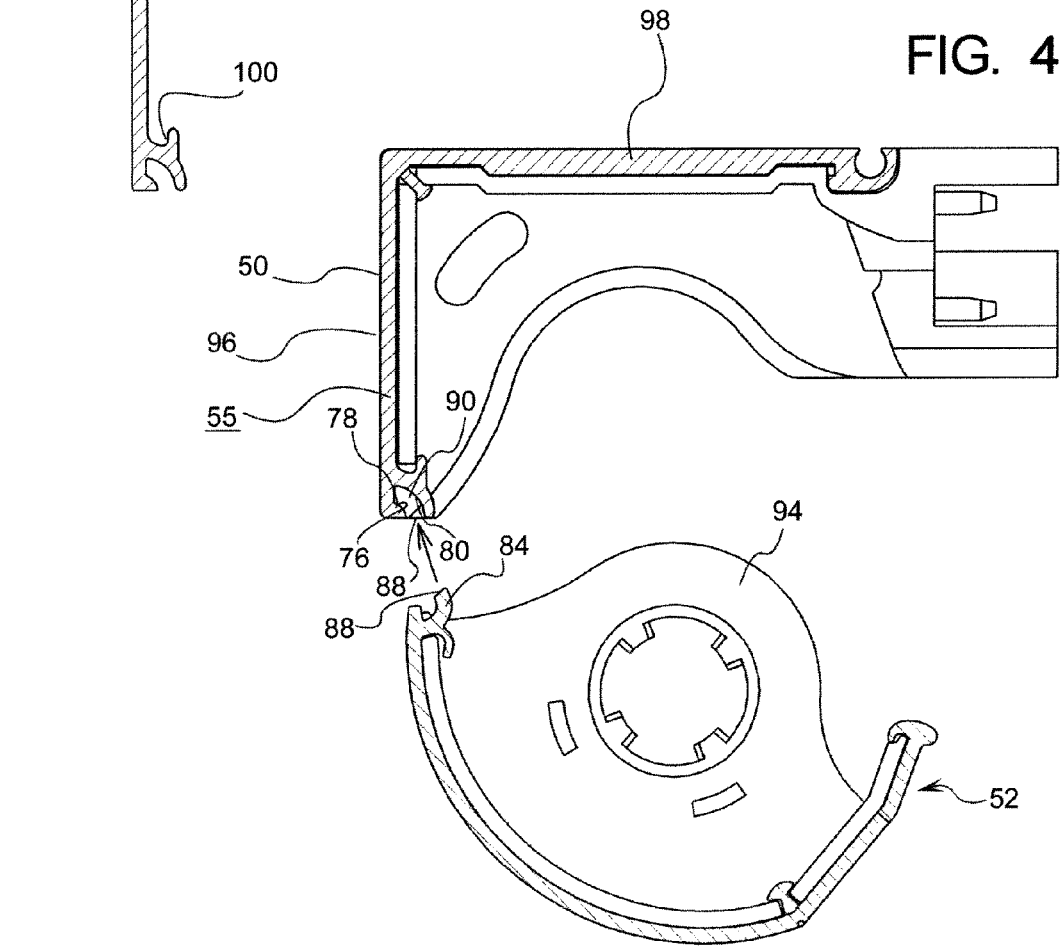
FIG. 4 shows the base housing in two components where the outer shell is adapted to be rotatably mounted to the base shell.

Now referring to FIG. 4, there is shown the outer shell 52 operatively configured to engage a longitudinally extending slot 76 extending along the transversely extending member 55. In a preferred form, the longitudinally extending slot has the first radial surface 78 and the second radial surface 80, both which are, in a preferred form, substantially partially cylindrical in nature and adapted to receive the locking extension 84. The locking extension 84 has a partial cylindrical shape where the forward portion 86 is adapted to engage the surface defining the longitudinally extending opening 88, where as shown in FIGS. 3-6, the locking extension 84 is partially within the longitudinally extending chamber portion 90 and operatively configured to partially rotate therein to a locked configuration as shown in FIG. 6. The lower base of the outer shell 52, in one form, is a separate piece from the shell region 92. The lower base cap 94 in one form can be, for example, a plastic piece which snaps to the lower portion of the shell region 92, which can be an extruded portion of aluminum.

Figure 5:
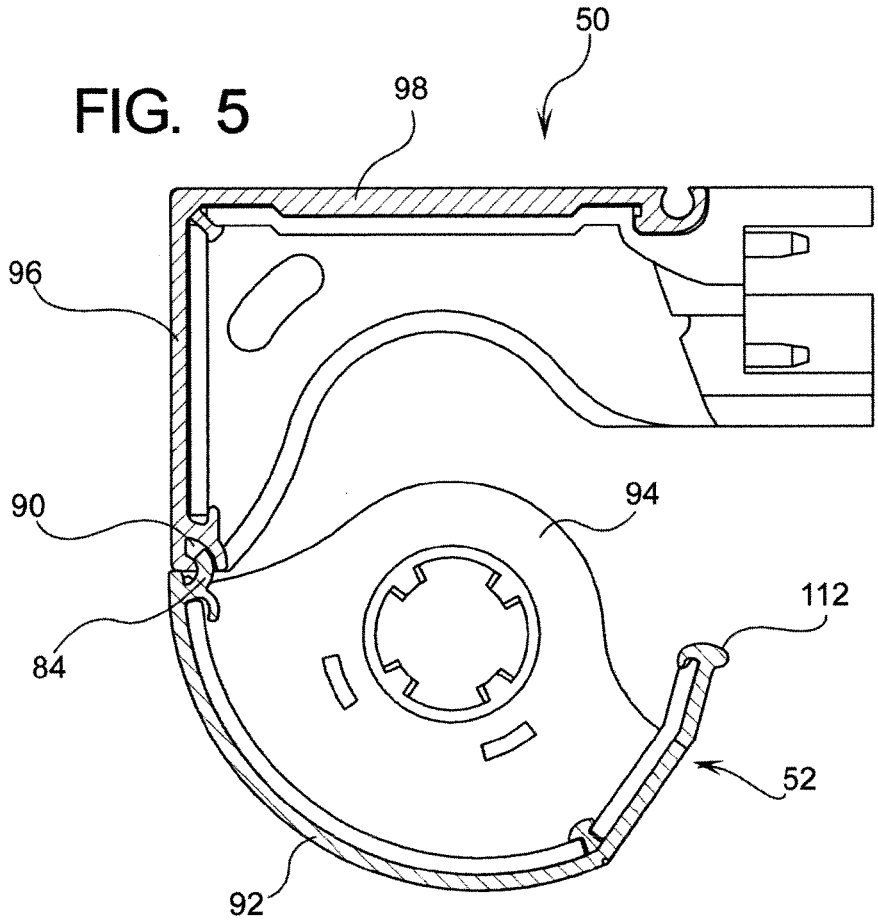
FIG. 5 shows a locking extension being fitted within a longitudinally extending slot of the L-shaped base shell.
Figure 6:
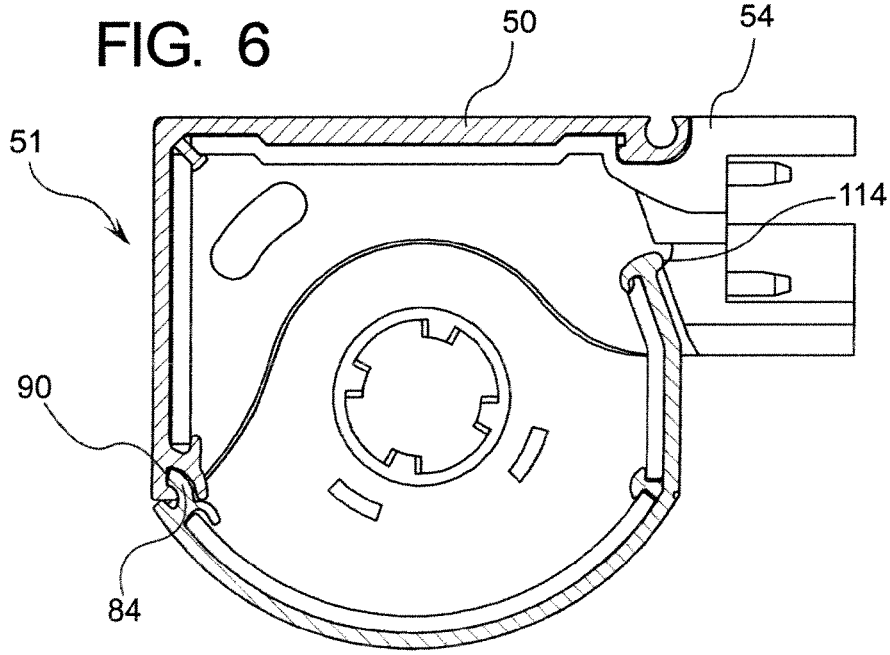
FIG. 6 shows the outer shell being rotatably attached to the L-shaped base shell.

Referring to FIG. 5, the base shell 50 comprises a transversely extending portion 96, and a rear wall 98. The recessed portions indicated at 100 and 102 are adapted to engage the small extension portions 104 and 106 of the lower end cap 54. Further, the corner extension 108 can fit within the recessed portion 110 to snugly fit the end caps thereto. Of course, any kind of extension and locking system can be utilized, and in one form, the base shell is comprised of components, but of course could be comprised of any number of components or be constructed of a single unitary unit.

Referring ahead now to FIG. 6, it can be seen that the base shell 50 is presumably fixedly attached to a door perimeter in one form by a perimeter region of an opening with a screw or the like. As described above, a preferred method of fixedly attaching is using the dual-headed screw to properly space from the perimeter region, which is thoroughly described in U.S. Pat. No. 6,478,070, which as noted above is incorporated by reference and provides some background information on one method of installing the unit. Of course, any method can be utilized for installing the base structure.

FIG. 6 illustrates how the locking extension 84 fits within the chamber portion 90 defined by the first and the second radial surfaces 78 and 80, which is best shown in FIG. 4. This rolling-like action allows for a lever-like effect so the locking extension 112 of the outer shell 52 engages some portion in the end cap, and as shown in FIG. 6, the lower end cap 54. For example, the slight recessed portion 114 is adapted to receive the locking extension 112 and virtually engage thereto. Of course, any number of types of locking mechanisms can be utilized, but have a slight inward deflection of the screen of the outer shell 52, and having the locking extension 112 temporarily displace radially inwardly, and then extend radially outwardly to snugly fit within the slight recessed portion 114. This is one desirable method of locking the unit together so the entire structure of the outer shell 52 and the base shell 50 comprises the base housing, generally denoted by numeral 51. Of course, it should be noted that in one form, as shown in FIG. 4, the first and the second radial surfaces 78 and 80, which are vertically oriented along the path (or at least a portion of the length) of the base shell 50 in one form are partially cylindrical in nature. Of course, any number of surfaces between the locking extension 84 and the first and the second radial surfaces 78 and 80 can be utilized to allow a rotating-like effect of the outer shell 52 to properly engage and lock to the upper and lower portions of the retractable screen door assembly 20. Of course, it should be noted that in one preferred form, the vertically extending components are extruded, and the end portions can be, for example, plastic injected components. This allows for one method of manufacture. It should also be noted, with reference to FIG. 6, that the locking extension 112 has a certain amount of flex to it as it rotates about the rotation point defined near the locking extension 84.

Figure 7A:
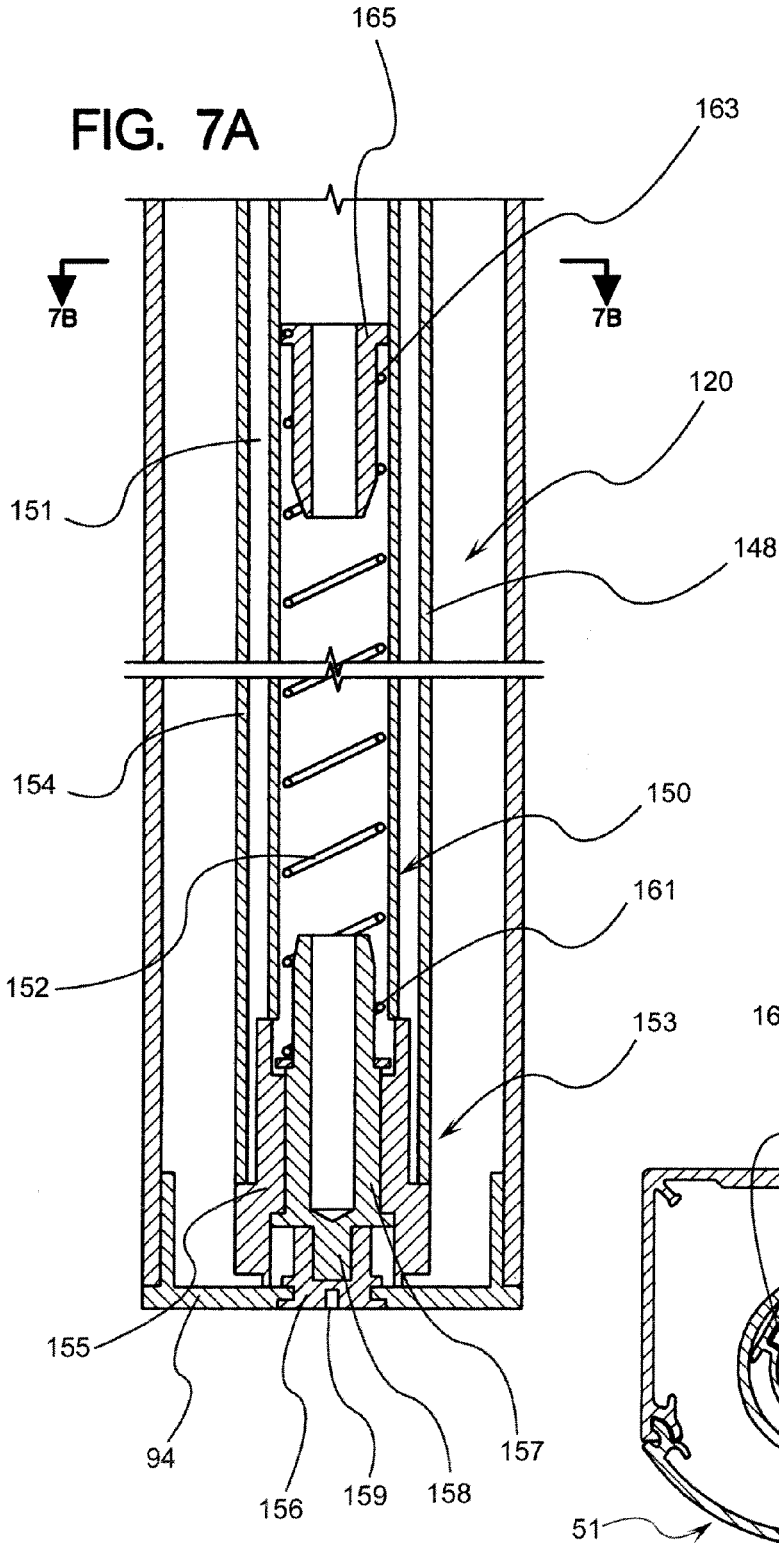
FIG. 7A shows a screen retraction assembly in a sectional view.
Figure 7B:
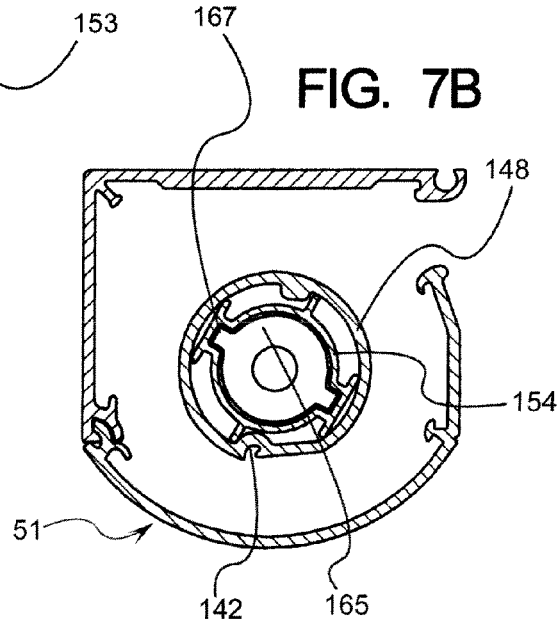
FIG. 7B shows a top sectional view taken at line 7B-7B in FIG. 7 of the screen retraction assembly showing how the inner plug repositions vertically therein the inner rod.

As seen in FIGS. 7A and 7B, the balancing cord retraction system 120 comprises an elongate tube 148 and a spring system 150. The spring system 150 has a first portion 151 and a second portion of the spring system 153 comprising the spring 152 (more particularly the second end 163 of the spring 152), inner rod 154, end cap 155 and the inner plug 165. The inner rod 154 has an extension portion 158 discussed further herein. The spring 152 has a second end of the spring 163 that is rigidly attached to the first portion of the spring system 151 of the spring system 150 to the inner plug 165 that is described further herein. The vertically opposite portion of spring 152 at the first end of the spring 161 is rigidly attached to the static plug 157.

In operation the first portion 151 of the spring system, namely the elongate tube 148, the inner rod 154, the inner plug 165 and the upper portion of the spring 152 (the second end of the spring 163) all rotate to unwind and wind up the screen (not shown) that is wrapped around the elongate tube 148. Therefore the end cap 155 rotates around the static plug 157.

When adjusting the spring tension, the adjustment cap 156 will rotate in the direction to increase the torsional tension of the spring. In FIG. 7A looking from the bottom this would be a clockwise rotation. The inner surface of the end cap 155 is adapted to be received by the static plug 157. Therefore the entire elongate tube 148 rotates with respect to static plug 157. The extension portion 158 is adapted to be received by adjustment cap 156. Therefore adjustment cap 156 will rotate the static plug 157 when adjusting the tension of the spring 152. The adjustment cap 156 has a plurality of tangentially inclined ridges that are adapted to engage the forward portion of ridges in a ratcheting region of the lower base cap 94 discussed above. A central surface 159 creates a recessed region that is adapted to receive the head of a screwdriver for adjustment discussed further herein.

The elongate tube 148 as shown in FIG. 2 has an indentation 170 extends vertically along the outer surface and is adapted to receive the flange 142 on the spline 140 of the retractable screen 42. The replacement of the retractable screen 42 can be accomplished very easily by removing the elongate tube 148 from the outer shell 52 and removing the spline 140 from the indentation 170. The screen is further removed from the handle 44 by removing the bumper 39 from the first end of the balancing cord 202.

Referring now to FIG. 7B it can be seen that the inner plug will vertically extend within the inner rod 154 while different tensions are applied to the spring during operation (as well as adjustment). By allowing the second end of the spring 163 to vertically reposition within the inner rod 154 it has been found that the noise produced by the spring system 150 has been reduced. The lateral extensions 167 are received by the indentation portion of the inner rod to transfer torque therebetween. The inner rod can be a single unitary unit with the elongate tube 148; however, in one form of manufacture these are separate units. The various flanges of the inner rod 154 engage inward extensions of the elongate tube 148 and further can frictionally engage therein.

Figure 8:
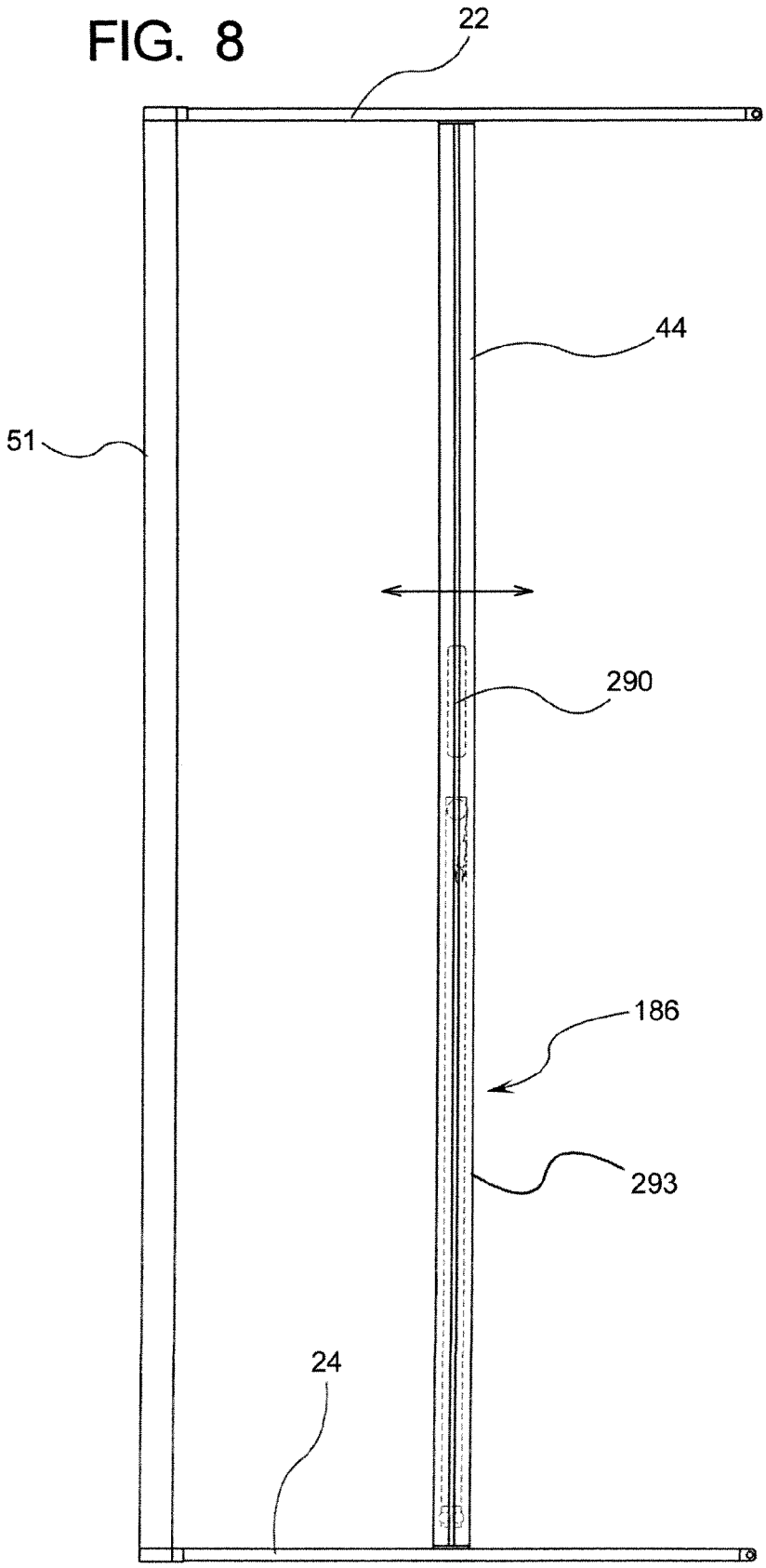
FIG. 8 shows a front environmental view of the unit showing the balancing cord elongation assembly 186 in a hatched-like line.
Figure 9:
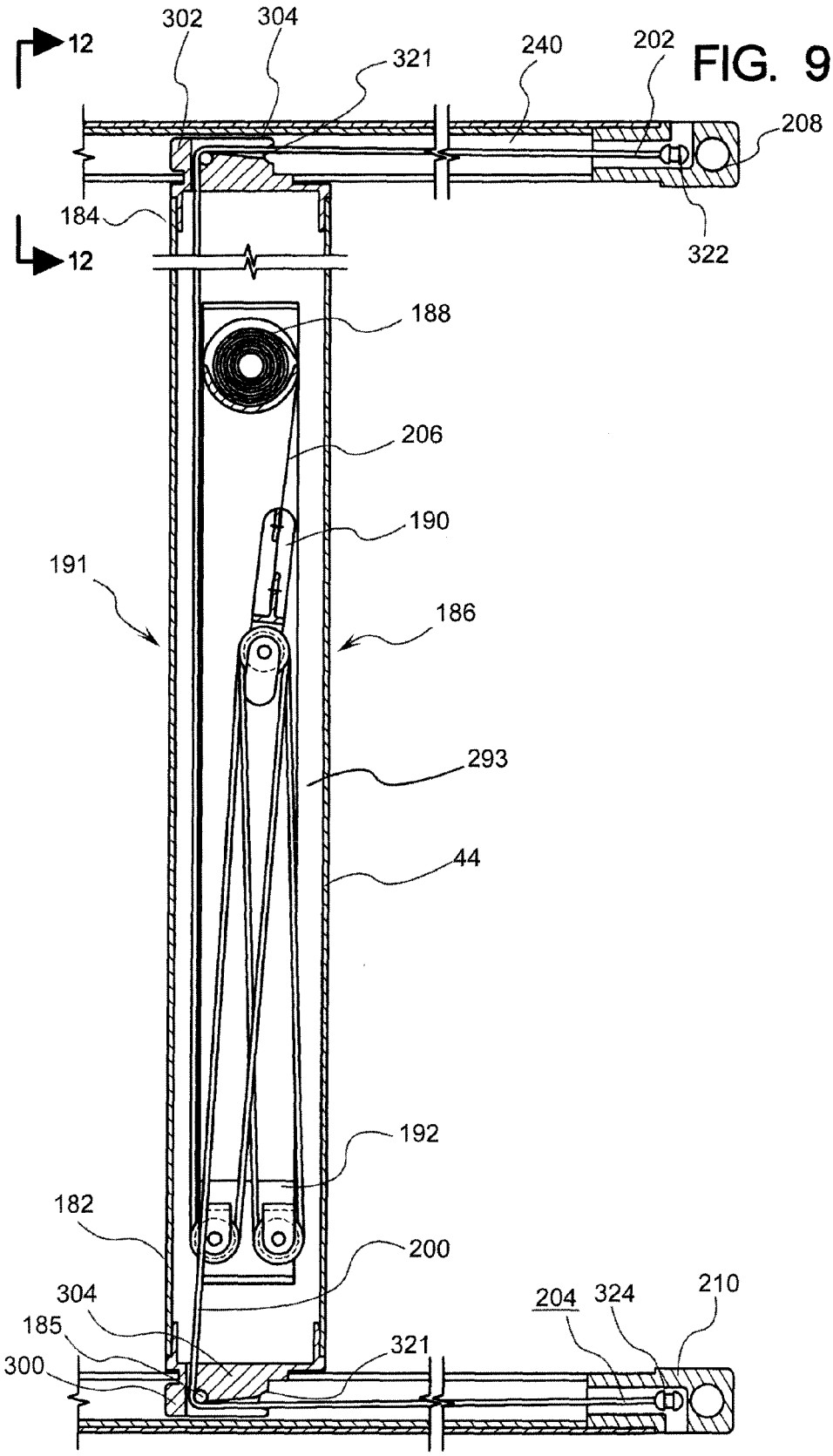
FIG. 9 shows a partial sectional broken view showing the upper and lower bracketing components attached to the handle where the handle is shown in a partial sectional view illustrating the cord elongation assembly which in one form is a block and tackle pulley-like assembly.
Figure 10:
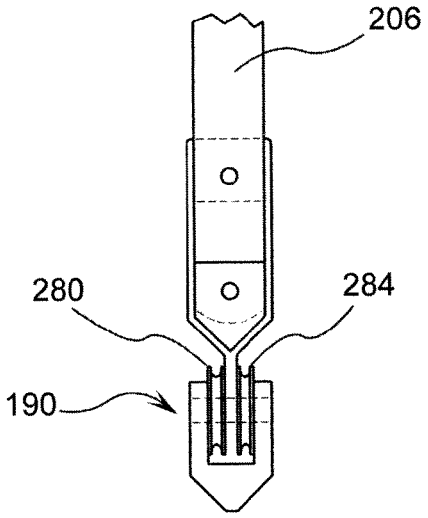
FIG. 10 shows the side view of the first pulley member.

With the foregoing description in place, there will now be a discussion of the handle 44 which is shown in a front environmental view in FIG. 8. Referring back to FIG. 2, it can be seen how the handle 44 extends substantially in the vertical direction. As shown in FIG. 2, the handle 44 comprises the elongate structure 180 which extends from the lower portion of the handle 182 as shown in FIG. 9 to the upper portion of the handle 184. An insert plate 187 is positioned in the substantially open portion 189 of the elongate structure 180. The handle 44 has an inner surface 193 which is a portion of the elongate structure 180 as well as an inner surface 195, which in one form is a portion of the insert plate 187. The inner surfaces 193 and 195 (see FIG. 2) form an interior chamber which is adapted to house the balancing cord elongation assembly 186, as best shown in FIG. 9. In general, the cord elongation assembly is adapted to take up slack of the balancing cord 200, which in one form is a continuous loop extending from the first end of the balancing cord 202 to the second end of the balancing cord 204. The balancing cord elongation assembly 186 generally comprises the aforementioned balancing cord 200, a biasing member 188, a first pulley member 190 and a second pulley member 192. The first and second pulley members 190 and 192 should generally comprise a pulley system 191, which in one form is a block-and-tackle-like pulley system where multiple pulleys are utilized to provide extra extension of the first and second ends of the balancing cords 202 and 204 as they extend from the handle 44.

The handle as shown in FIG. 2 has the extension 47, which extends vertically and can have rearward and forward surfaces 49 and 57 to allow repositioning of the unit. The handle indentation 290 in one form can be a portion of the handle to allow movement of the block and tackle assembly at upper or lower portions. The handle indentation 290 again has forward and rearward surfaces 291 and 293 for supplying a force thereto.

The first end of the screen 43 extends vertically along the handle 44. As shown in FIG. 2, and in one form the bumper 39 fits the first end therein to be held in place. Of course, the bumper can also absorb some impact when the screen is shut although with the balancing system in place, the screen dispenser 40 does not exert as much, if any, acceleration on the handle to prevent the door from slamming shut.

Figure 13:
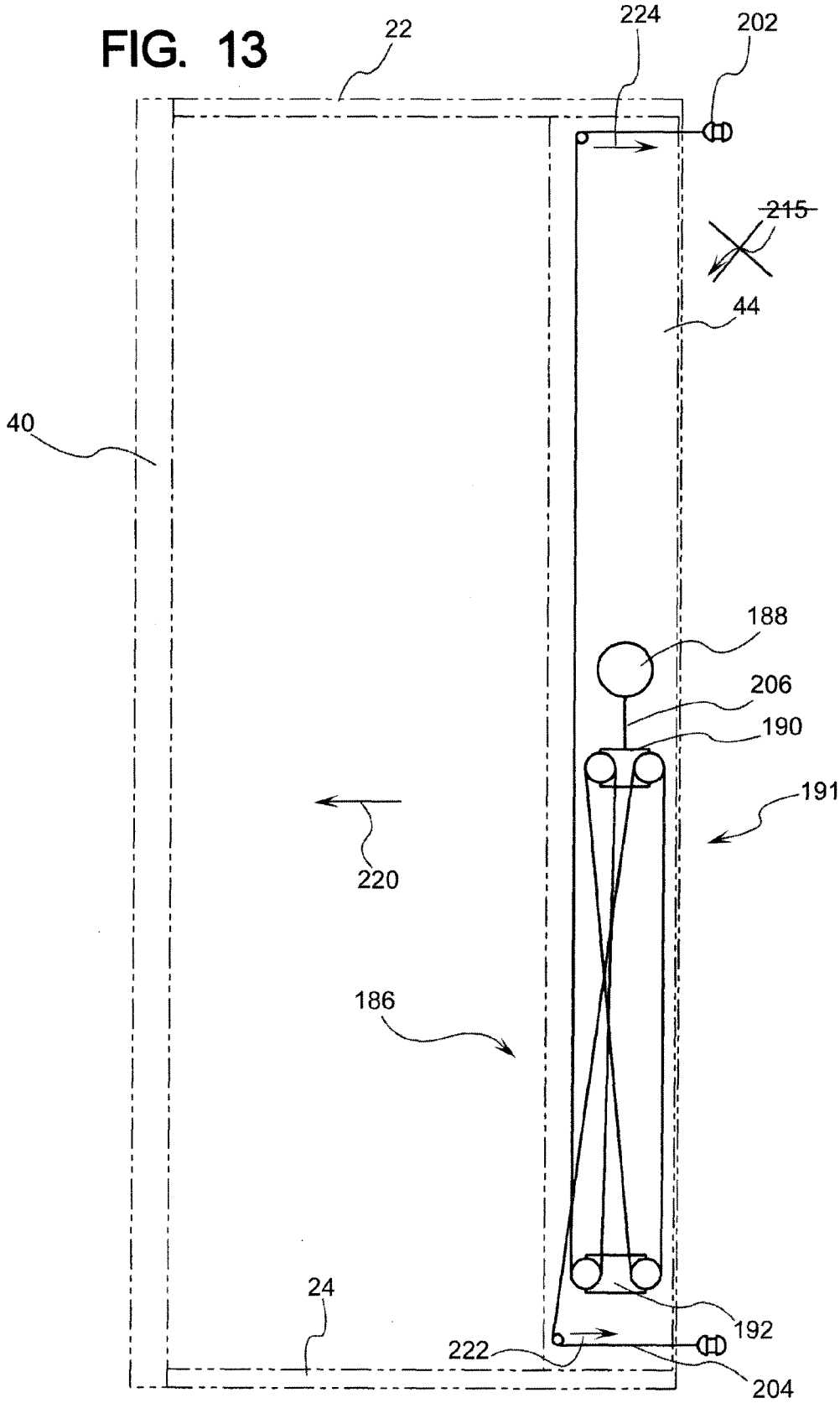
FIG. 13 schematically shows the balancing cord elongation assembly, which in one form is a block and tackle like assembly with upper first and second pulley members; this figure schematically shows the one arrangement of a single piece of cord to extend around the block and tackle assembly and operate and extend to upper and lower portions of the handle.

Reference is now made to FIG. 13, which shows a highly schematic system where the screen dispenser 40 is positioned in the left-hand portion, and the upper and lower laterally aligned bracketing components 22 and 24 are schematically shown by a hatched line. Further, the handle 44 is shown highly schematically, where the first and second ends of the balancing cord 202 and 204 are schematically indicated to be fixed to the distal end portions 208 and 210 of the upper and lower laterally aligned bracketing components 22 and 24 respectively (see FIG. 9.) However, FIG. 13 schematically shows one form of pulley system 191 where the biasing member 188 is schematically shown having an extension portion of the biasing member 206 extending therefrom. In general, the biasing member 188 is a spring-like member and can be any number of types of springs. However, certain biasing members such as constant force springs appears to have the property of a constant force or a substantially constant force pulling therefrom. FIG. 13 illustrates the general principle that the force acting upon the handle 44 biased from the counter-biasing system creating a counter-biasing force where it is schematically indicated how the screen induced force 220 is pulling in a first lateral direction toward the screen dispenser 40. To counteract this force, which is really a function of the wind up spring as shown in FIG. 7, the balancing cord 200 at the upper and lower locations supplies a counteracting force that is schematically indicated by the vectors 222 and 224 (see FIG. 13). Basically, the sum of these vectors should be substantially zero where the handle will stay in any orientation along the track. Further, this prevents the handle from slamming shut when the wind-up spring takes in the screen as described above. Therefore, with the foregoing disclosure in place, it can be appreciated that the various components comprise the counterbalancing system to properly balance the forces in the lateral direction acting upon the handle 44. Of course, it should be noted that the preferred form of arranging the pulley is shown in a manner similar to that shown in FIG. 9, where the center axis for the first pulley member 190 is substantially orthogonal to that of the second pulley member 192. However, for the sake of explanation, in FIGS. 13-17 it is shown highly schematically to illustrate the cord path for the various pulleys.

Figure 14:
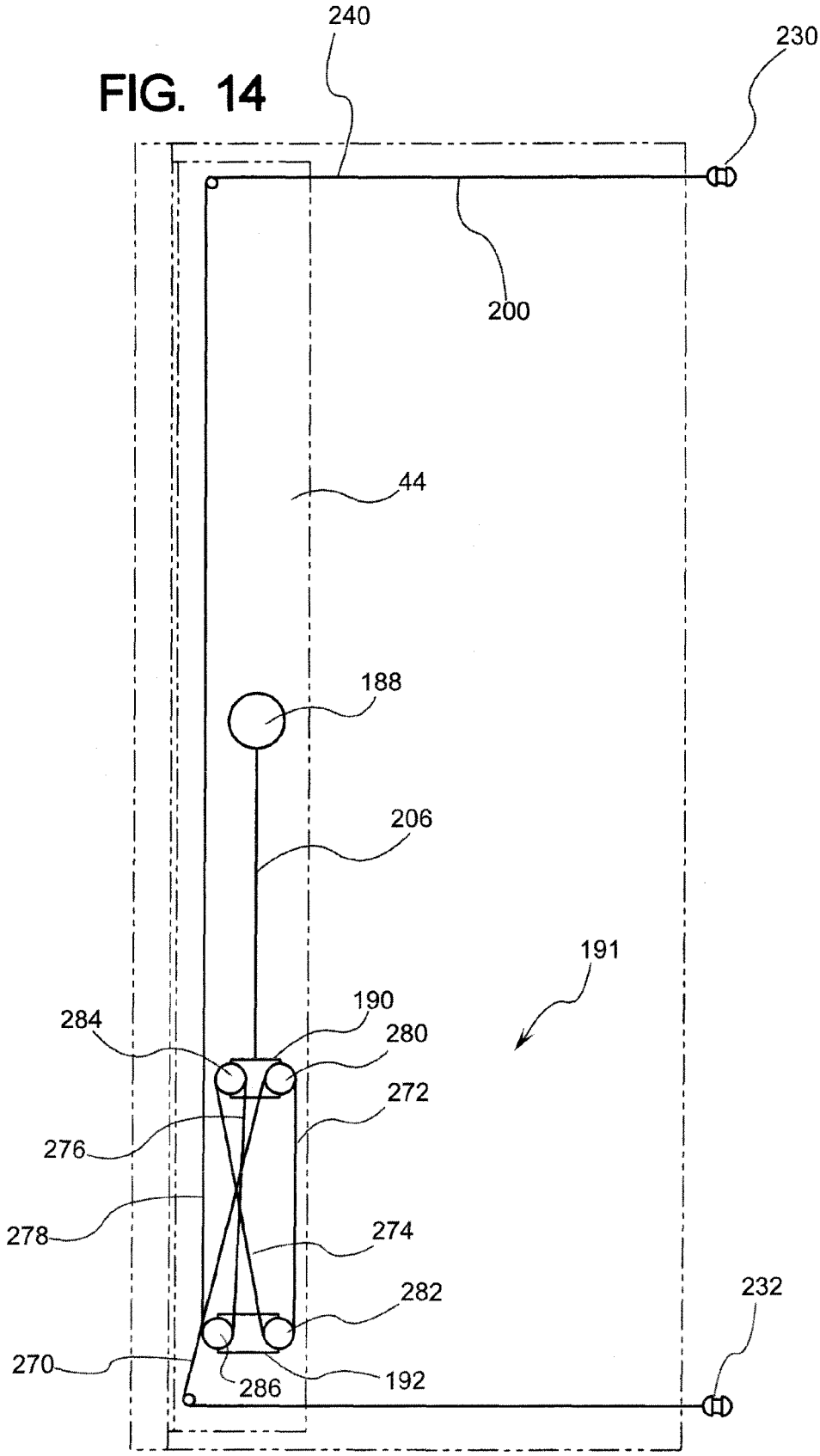
FIG. 14 shows the handle in a screen closed orientation where the first and the second pulleys are positioned in closer proximity to one another and the biasing spring-like member is in an extended configuration.
Figure 15:
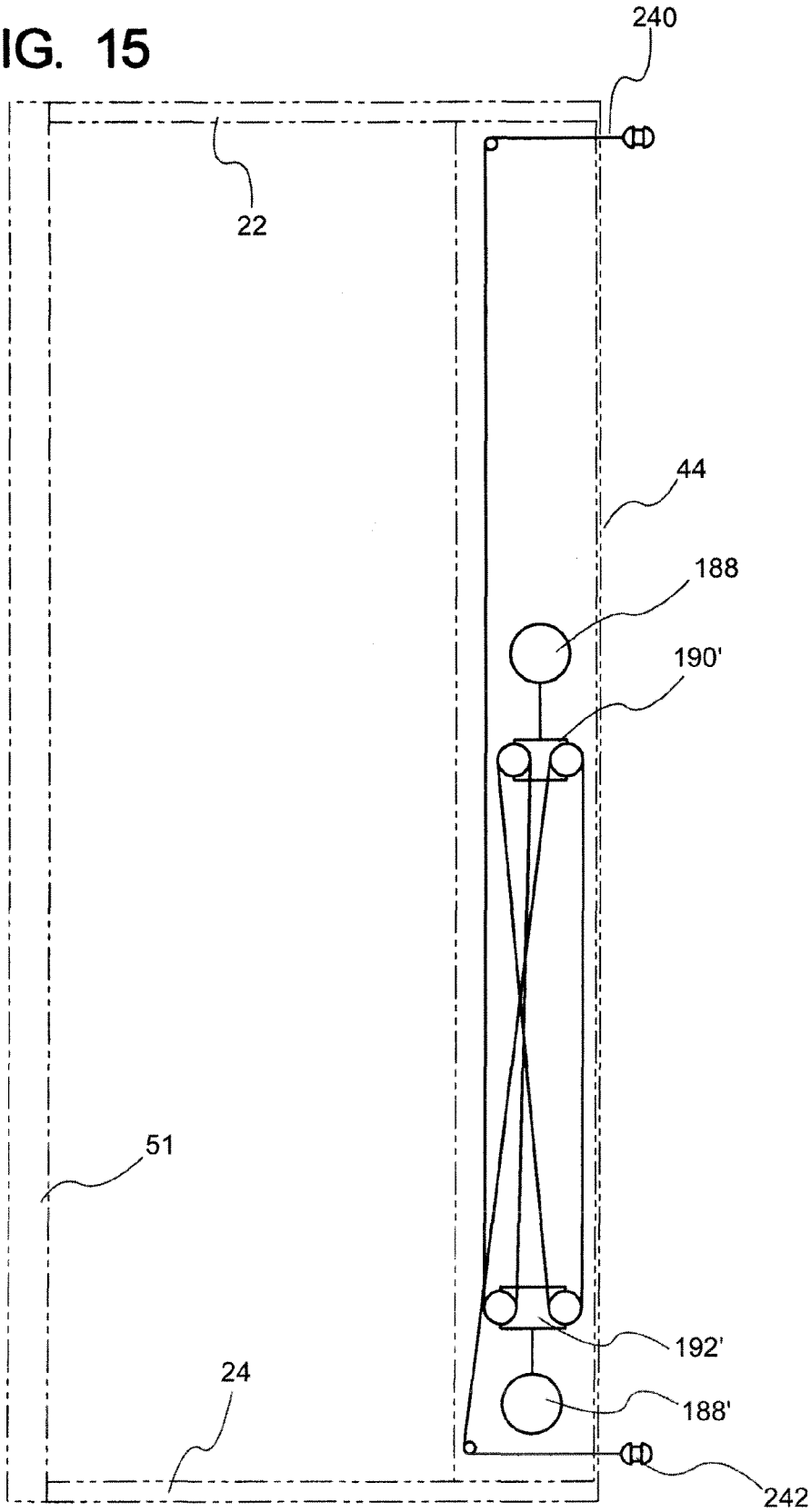
FIG. 15 schematically shows another embodiment where first and the second biasing spring-like members are utilized where both of the block and tackle assemblies are movingly positioned within the interior chamber of the handle.

Referring to FIG. 14, it can be seen how the balancing cord 200 which can be any type of flexible material, and in a preferred form is one continuous piece of material. However, this material is defined in certain sections where an upper section of the balancing cord 240 extends from the handle 44 and is terminated at the first anchor point 230. In a similar manner, the lower section of the balancing cord 242 extends from the handle 44 and is anchored at the second anchor point 232. In a preferred form the first and second anchor points 230 and 232 are the end portions of the upper and lower laterally aligned bracketing components 22 and 24 but in other forms could be say for example a portion of the door frame.

In FIG. 14 the biasing member 188 is shown in a high-energy state where the internal spring-like mechanism of the biasing member is wound to store potential energy therein. The extension portion of the biasing member 206 is in an extended configuration where the first pulley member 190 is in closer proximity to the second pulley member 192. Where in the form where the balancing cord 200 is substantially non-elastic, the net length of the cord does not substantially change so the having the pulley members be biasedly positioned away from one another creates the tension in the upper and lower sections of the balancing cords 240 and 242.

As shown in FIG. 14, in one form the pulley system 191 is positioned beneath the handle (as shown in FIG. 8). FIG. 14 schematically shows the path of the cord whereby the portion of balancing cord 270 extends around the pulley member 280 and then extends back around to the pulley member 282, which is a portion of the second pulley member to the extension portion of the balancing cord 272. Thereafter, the extension portion 274 extends up and around the pulley 284 of the first pulley member 190 and extends back around a portion of the balancing cord 276 around the pulley 286 and finally back up the long vertical length of the balancing cord 278 which passes past an opening in the handle portion. As shown in FIG. 2, the handle indentation 290 is an inward recess portion for grabbing the unit. The adjacent openings 292 and 294 are generally slender enough to allow a cord to pass therethrough. In one form, the first pulley member 190 is too large of a unit to pass around such a portion. That is why, in one form, first and second pulleys members 280 and 284 of the first pulley member 190 are utilized in conjunction with the first and second pulley members 282 and the pulley 286 of the second pulley member 192 are shown in FIG. 14. Of course a block and tackle-like pulley assembly allows for a greater amount of extension of the upper and lower sections of the balancing cord 240 and 242 with respect to the displacement of the first and the second pulley members 190 and 192 as they travel towards one another.

Referring back to FIG. 13, it can be seen how the first and the second pulley members 190 and 192 are positioned apart from one another and the biasing member 188 is in a lower energy state and the extension portion of the biasing member 206 is wound therein.

Referring back to FIG. 9, there is shown a less schematic version of the unit where the lower and upper portions 182 and 184 of the handle 44, have lower and upper track members 300 and 302 which are adapted to extends in the upper and lower laterally aligned bracketing components 22 and 24. It should be noted that the balancing cord diversion member 185 in one form is a static type member which provides a slight frictional engagement of the balancing cord passing therearound. Of course in one form the pulley-like member could be applied here; however, it has been found that having a slight frictional resistance of the cord passing around the substantial 90° angle creates a slight dampening effect as the handle is repositioned in the lateral direction.

Figure 12:
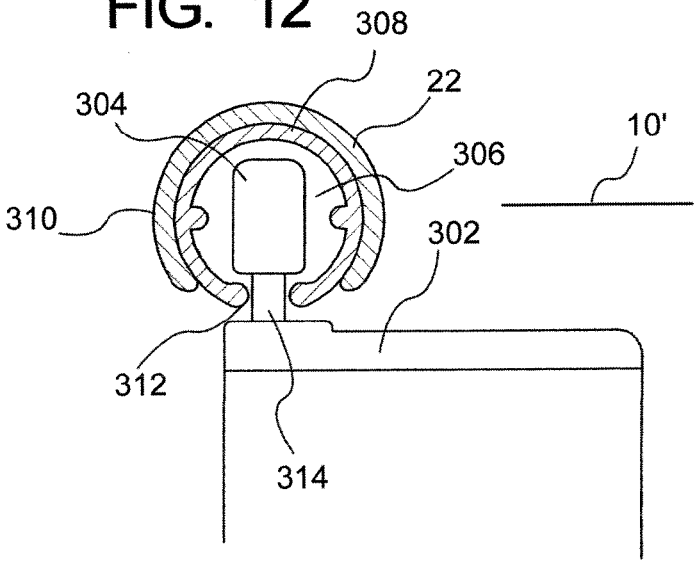
FIG. 12 shows a sectional view of one form of the bracketing component taken at line 12-12 of FIG. 9.

As shown in FIG. 12, the upper laterally aligned bracketing components 22 is shown where the inner member 308 has the inlet 304 that is adapted to travel within the chamber region 306 of the inner member 308. Referring to FIG. 12, it should be noted that in one preferred embodiment, the upper and lower attachment portions of the handle member are not adapted to have a torque about the transverse axis 10'. In other words, if the handle has any substantial amount of torque applied to it about a transverse axis, the handle will tend to get skewed within the upper and lower laterally aligned bracketing components 22 and 24. In other words, because in one form the bracket members substantially terminate at the fully opened orientation of the handle, and further the bracketing members do not extend beyond the base housing 51, there is no opportunity to provide any laterally extending structure within the bracket members that is attached to handle to counteract any torque placed on the handle about the transverse axis.

In general, the upper laterally aligned bracketing component components 22, in one form, is similar to the track members as shown in U.S. Pat. No. 6,478,070 where essentially the inner member 308 can rotate with respect to the outer member 310. Of course, this allows for some of variability in the orientation of the outer member 310 where the inner member can be aligned in a manner where the laterally extending slot 312 is substantially perpendicular to the neck region 314 of the inlet 304.

Figure 11A:
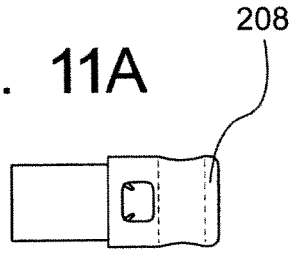
FIG. 11A shows the distal end cap of each of the upper and lower bracketing components showing the access port exposing the interior locking extensions.
Figure 11B:
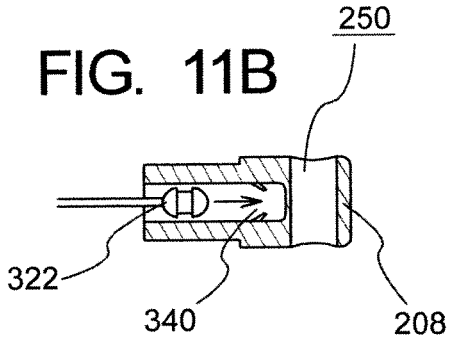
FIG. 11B shows the end lock of the balancing cord being fitted to hit the locking extensions, which occurs in one form when the door is first configured and opened fully in a fully extended manner.
Figure 11C:
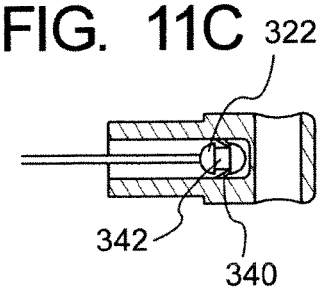
FIG. 11C shows the end lock of a balancing cord fixedly attached to the distal end.

Referring back to FIG. 9, it can be seen that the inlet 304 provides a base holder surface 321 which is adapted to support the lock end 322 as well as the support lock end 324 in the lower portion of the unit. Basically, the tension placed upon the upper and lower sections of the balancing cord 240 and 242 of the balancing cord 200 initially biases the lock ends 322 and 324 in the base holder 320 where the rearward portion of the lock end 322 nestles within the base holder 320. It should be noted that this initial orientation of the lock end 322 being nestled into the base holder 320 is only upon the first installation. After the door is opened and slammed wide open once, as shown in FIG. 11B, the lock end 322 is adapted to engage the locking extension 340 in a manner as shown in FIG. 11C. Basically, the locking extension 340 extend radially inwardly, and engage the annular groove 342 of the locking member. FIG. 11A shows a bottom view of the distal end portion of the laterally aligned bracketing component 208 where an access port allows for the locking extensions to be pried open to release the lock end 322 in case the unit must be disassembled for some reason.

It should be noted that the distal end portion of the laterally aligned bracketing component 208 comprises a threaded receiving portion 250 which is adapted to have, for example, a double threaded screw or the like pass therethrough.

It should be reiterated that the steps as shown in FIGS. 11B-11C are only executed the first time the doors completely open. Thereafter, the lock end 322 is attached to the distal end portions of the laterally aligned bracketing component 208 and 210 as shown in FIG. 9.

With the foregoing description in place, there will now be a brief discussion of other potential embodiments. Referring now to the schematic embodiment FIG. 15, in this form, the biasing member 188 is fixedly attached to the frame member in a similar manner within the handle as described above. However, in this form, the second biasing member 188' is also placed therein, therefore the first and second pulley members 190' and 192' are both movable in the chamber portion of the housing. As long as there is a certain amount of biasing resistance from the unit to inhibit the motion of the first and second pulley members from becoming closer to one another, the counterbalancing force of the upper and lower sections of the balancing cord 240 and 242 is achieved.

Figure 16:
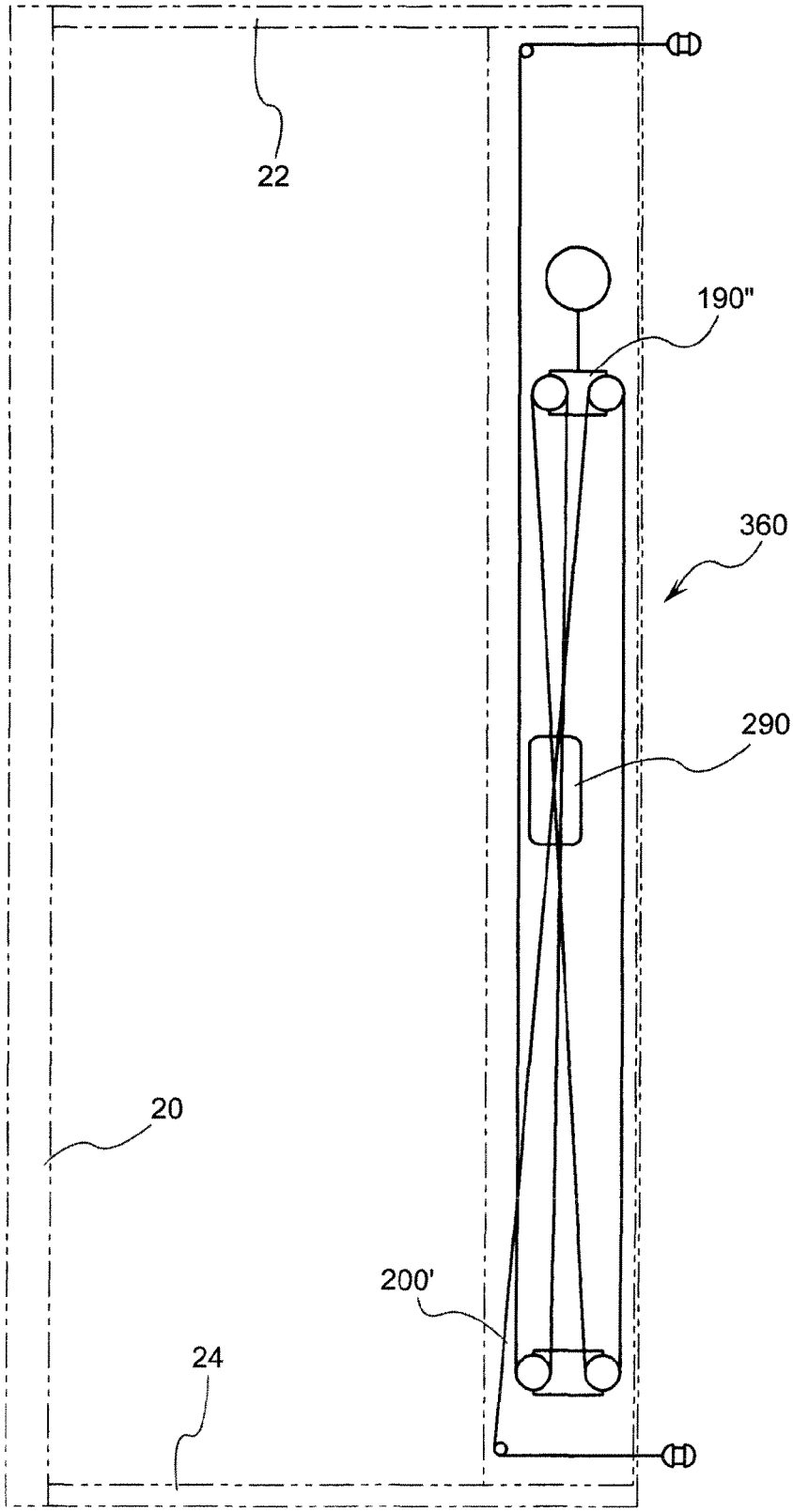
FIG. 16 shows another embodiment where one of the block and tackle assemblies is positioned above the handle, and the various cords pass around a handle portion of the unit.

Referring now to FIG. 16, there is shown another embodiment, where in this form, the first pulley member, for example the first pulley member 190" is positioned above the handle indentation 290. Of course the various portions of the balancing cord 360 would likely be positioned in the openings 292 and 294 as shown in FIG. 2. However, for the purposes of illustrating the path of the balancing cord 200', there is shown a more schematic version.

The substantially open portion 189 is a grasping region as shown in FIG. 2. In many forms it is desirable to have a grasping portion opposite to the extension portion of the handle 47 on the opposing side. However, the openings 292 and 294 are formed within the rearward surfaces of the handle indentation 293 (see FIG. 8) of the handle 44. It should be noted that the embodiments such as that shown in FIGS. 13-17 are schematic, and the cords, when positioned on opposing sides of the substantially open portion 189, would travel around a perimeter portion of this indentation. For example, FIG. 16 shows a schematic form of one method of extending the balancing cord around the upper and lower pulley members. However, the pulley members would be orientated in a manner similar to that shown in FIG. 9 so the cords would extend to openings such as 292 and 294 as shown in FIG. 2.

Figure 17:
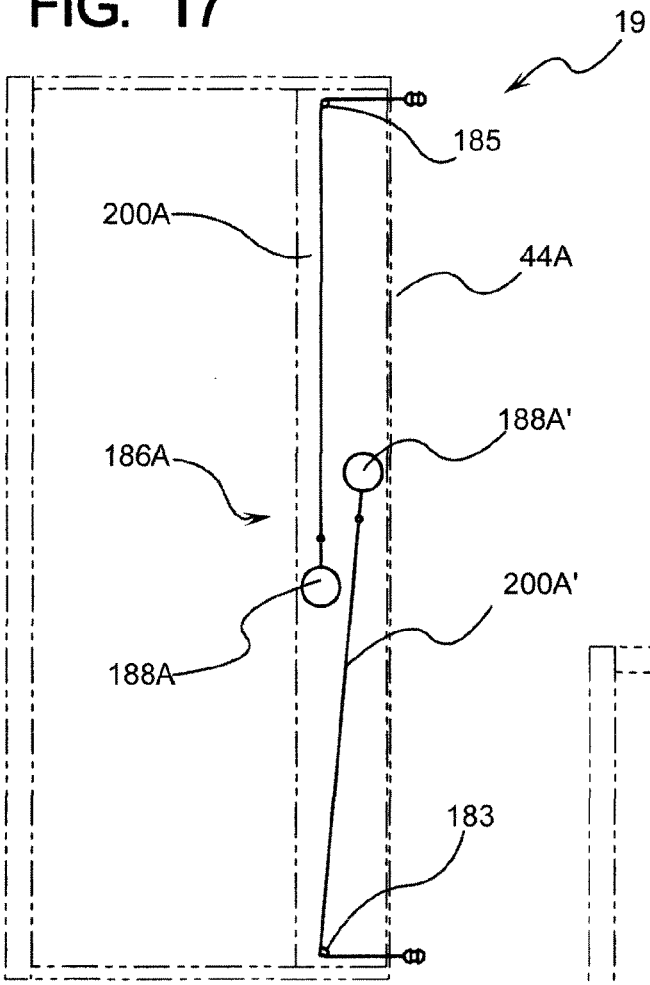
FIG. 17 shows yet another embodiment where upper and lower biasing members are utilized and the balancing cords are directly withdrawn within the biasing members.

Now referring to FIG. 17, another embodiment where in this form, the biasing members 188A and 188A' are positioned in upper and lower portions within the handle 44A. The balancing cord sections 200A and 200A' extend around the balancing cord diversion members 185 in a similar manner as shown in FIG. 9. In this form, a counterbalancing force is utilized, except instead of a block and tackle assembly, the balancing cord elongation assembly 186A basically comprises two biasing members.

Figure 18:
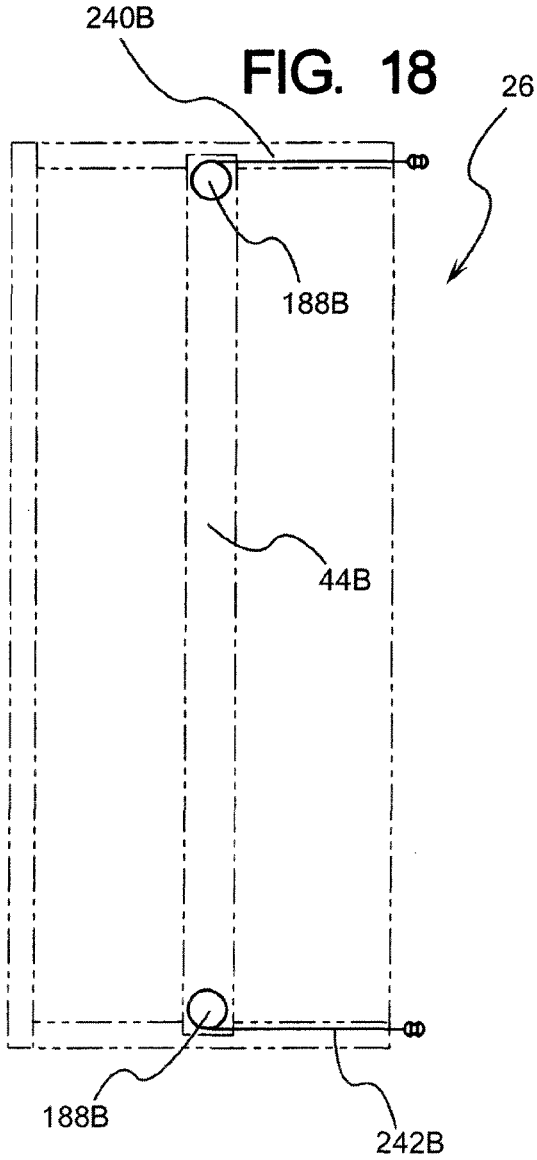
FIG. 18 shows another embodiment where two spring-like members are positioned at either portions of the handle and extend around the opposing end regions to supply a balancing force upon the handle.

FIG. 18 shows another embodiment where the biasing member 188B can, for example, have a cord extending therefrom. The biasing member 188B could for example be the mechanism as shown in FIGS. 22-27 described herein where the extendable string serves directly as the upper and lower balancing cords 240B and 242B. Of course in this configuration, the radially interior portion of the spool 330 would be positioned radically inwardly, whereby as the spool is more tightly wound, a jolt of greater force would be calibrated when the handle 44B is about to be fully extended with the screen being in a fully screen extended configuration.

Figure 19:
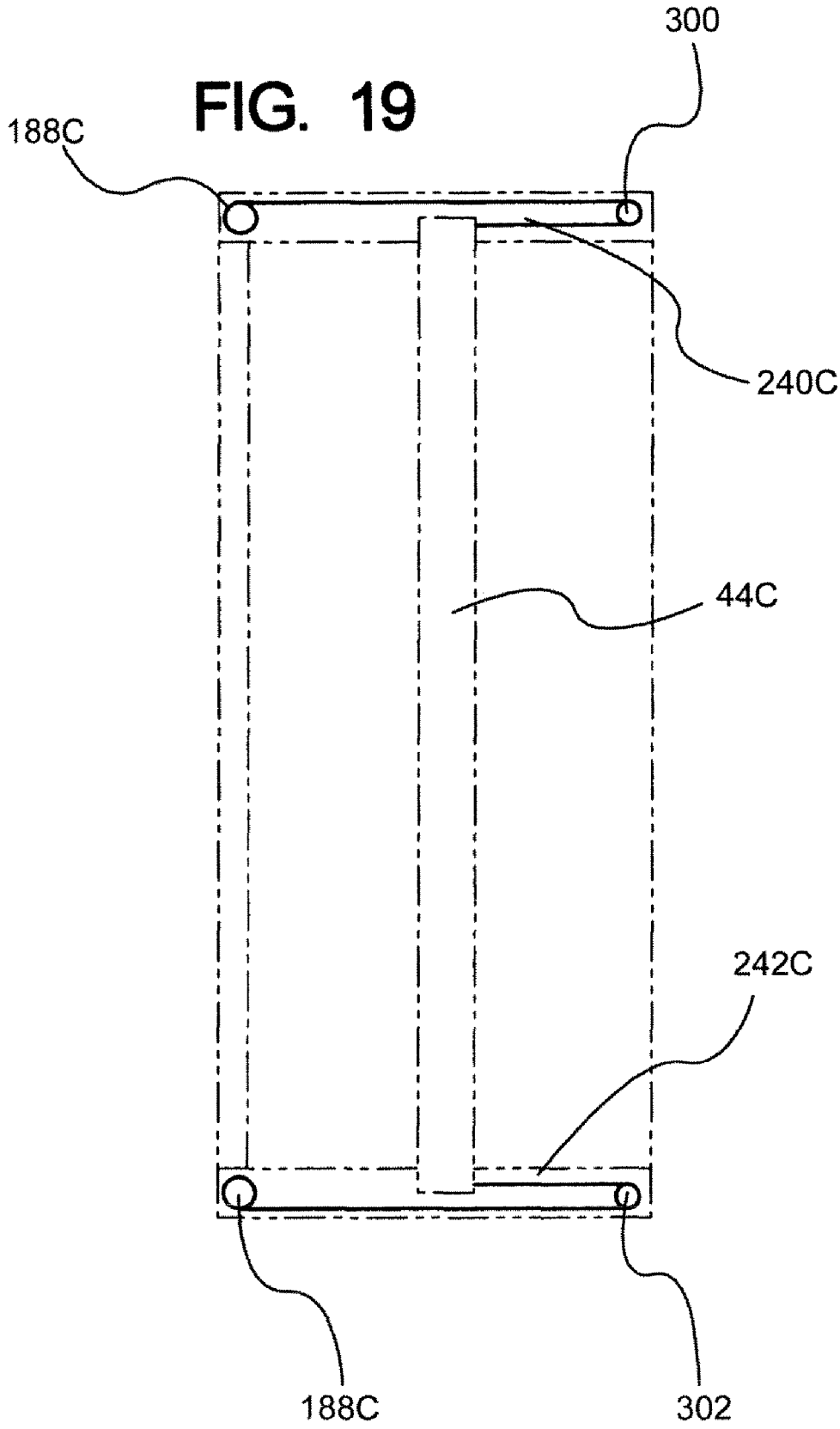
FIG. 19 shows another embodiment where a cord-like member is attached to the end portion of the handle and extends around the pulley to bias the handle in the first lateral direction.

Now referring to FIG. 19, there is shown another embodiment where the balancing cords 240C and 242C are positioned around the upper and lower track members 300 and 302, where for example, the biasing members 188C and 188C' are operatively configured to retract the cord sections extending around the upper and lower track members 300 and 302 respectively. Of course the spring members could be attached to, for example, the handle 44C.

Figure 20:
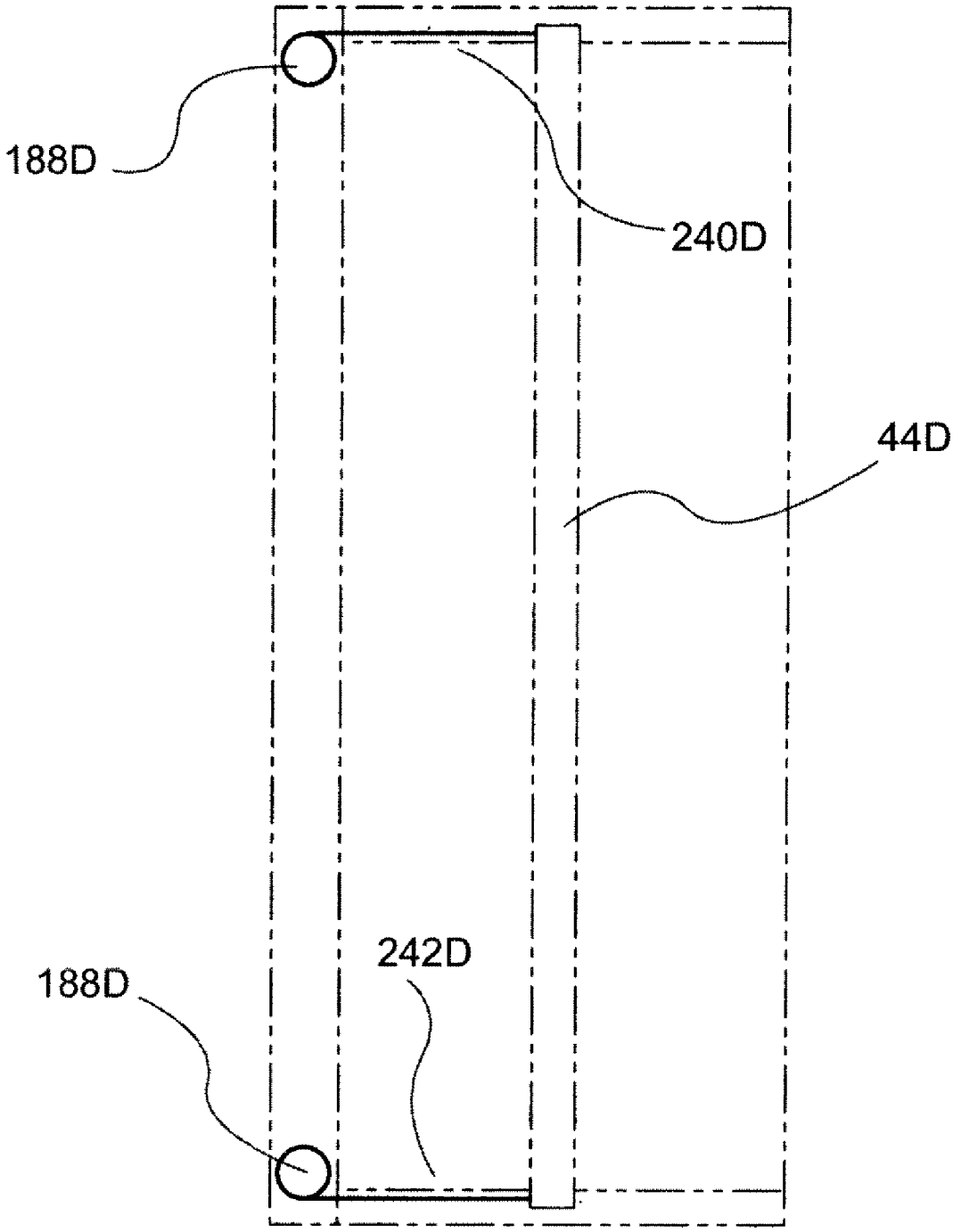
FIG. 20 shows another embodiment where a balancing cord in one form is configured of an incompressible-like structure, such as a chain link, to extend the handle in a first lateral direction to counter the force of the screen pulling in a second lateral direction.

FIG. 20 shows another embodiment where the balancing cords 240D and 242D in one form can comprise an incompressible type linkage assembly such as a chain that is housed within a chamber region 306. The unit is configured to forcefully unwind from the schematic biasing member 188D. Of course, a similar type of configuration would be positioned in the lower portion of the handle 44D. The balancing cords 240D and 242D are basically an incompressible extendable member similar to, say, an extendable and retractable measuring tape. The cross-sectional area of this member can be non-planar to have a certain amount of buckling resistance. Of course this member can further be positioned within some form of a tube or elongate structure to mandate of force upon the upper and lower portions of the handle in the first lateral direction and be configured of material as say for example a chain link structure.

Figure 21:
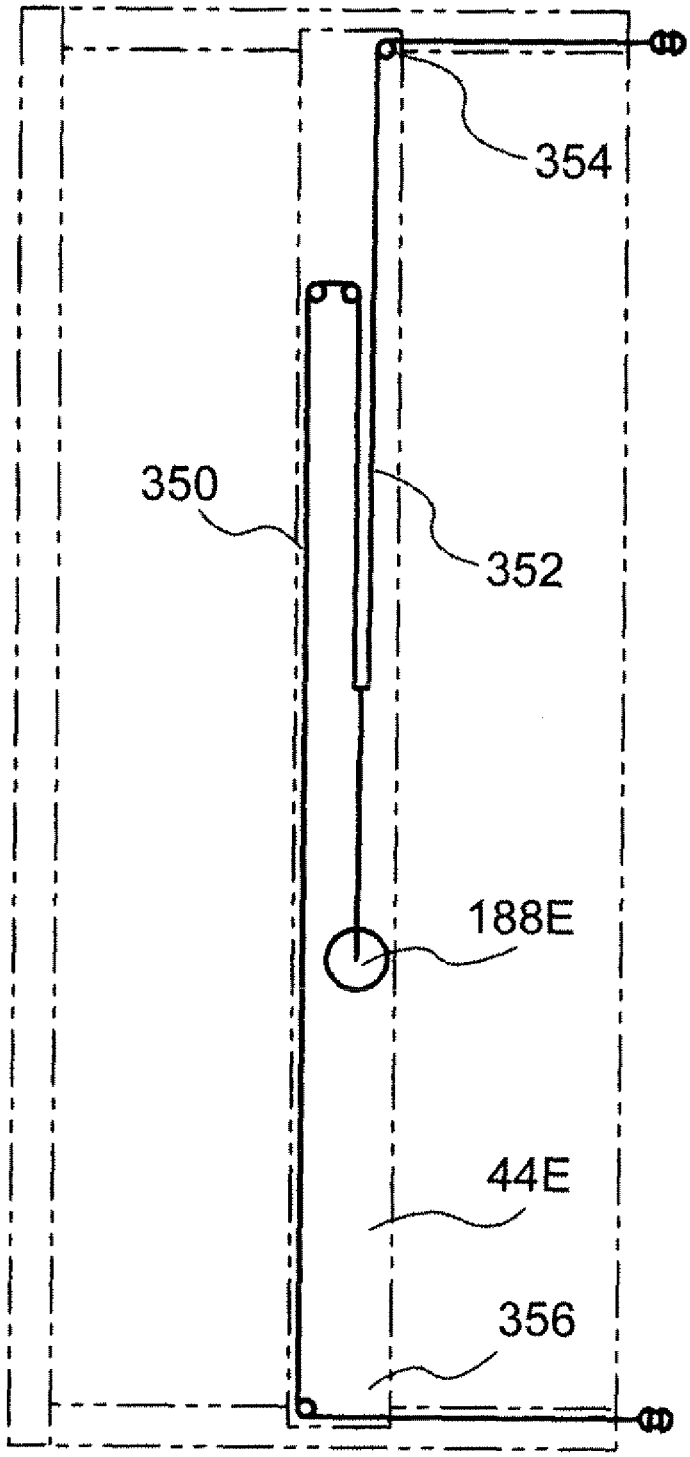
FIG. 21 shows yet another embodiment of an internal biasing system where at least one biasing component is attached to two lines that extend to upper and lower portions of the handle to place a force in the first lateral direction upon the handle to counteract the pull of the spring in the second lateral direction

FIG. 21 shows yet another embodiment where the biasing member 188E is attached to the first and the second balancing cords 350 and 352 which extend up around the portions of the handle 354 and 356 of the handle 44E. Of course, this and other alternatives show various forms of producing a counteracting force other than a frictional force at the upper and lower portions of the handle member.

FIGS. 22-27 shows an embodiment of one type of biasing member 188 which in this form is a partial constant force spring. As shown in the figures, the second biasing member 188' generally comprises a base holder 320 and a wind-up spool 323. The lock end 322 has a frustoconical property where the lever arm from the center axis 325 decreases as the spool unwinds. In general, the internal spring mechanism to the second biasing member 188' generally increases torque as it is in a higher energy state, which is normal with the spring constant of most materials and wind-up spring-like mechanisms. However, decreasing the diameter of the string pull essentially gives a lower moment arm which, if designed properly, can provide a substantially constant force applied to the cord (not shown) which is wrapped around the lock end 322. The opening which is defined by the surrounding surfaces indicated at the opening 326 can allow disbursement of the cord.

As shown in FIG. 26, the wind-up spool comprises the decreased diameter helical-like portion 347 which gradually decreases the diameter of the pull of the cord wrapped therearound, where this diameter is indicated at annular groove 342.

As the spring is fully unwound, the diameter can change in a manner as shown in FIG. 24 where the last portion of the pull can substantially reduce the diameter indicated at 328. This, for example, reduces the lever arm indicated at the interior portion of the spool 330 from, where for example, the lever arm indicated at 332 by a factor of 1:2 in one form, one unit of a unit of length of interior portion of the spool 330 compared to the length of lever arm 332 can be 1.2±2.5 length units for example. The size of the spool and the length can be configured in a manner so that when the handle is in the configuration and is about to be closed so is extra tension in the balancing cords right when the screen closes. This gives a desirable effect where, for example, the tension in the line wrapped around the wind up spring is say 3 pounds, it can increase to 5 pounds through the last bit to ensure that the handle is in a screen extended configuration. This gives an effect similar to say a fridge door closing by way of pressure differentials from within and without any outside portion of the fridge. Further, in general, individuals generally may intend the screen of the open extended configuration they desire it to be fully open. The extra force generated in the balancing cord elongation assembly 186 as shown in FIG. 9 can be generated by the second biasing member 188'.

Now referring back to FIG. 19, it should be noted that biasing member 188C could be similar to the second biasing member 188' shown in FIGS. 22-27. As noted above, FIG. 19 shows biasing members 188C the attached to the lower and upper portions where the biasing member directly attached or is a part of the upper and lower balancing cords. In this embodiment the inward portion 341 as shown in FIG. 27 would be narrower (to say the diameter shown at 330 near the outward portion 343 in FIG. 24) in diameter to allow a greater amount of force to be generated when the lock end 322 fully winds up the balancing cord and is about to fully extend the screen at say two to three inches from fully extended position.

The various figures, namely FIGS. 13-21, show various handle biasing means that are configured to provide a counterbalancing force in the substantially opposite direction as the force exerted by the screen. Of course, if, for example, the upper and lower laterally aligned bracketing components 22 and 24 were not straight, they could be arced, for example where the force of the screen and the upper and lower balancing cords would not be perfectly planar.

I claim:

1. A screen door system comprising:

a. a screen dispenser having an interior chamber and an outer shell which houses a spring-loaded screen extension system, the spring-loaded screen extension system comprising a screen mesh that is operatively configured to extend from the screen dispenser, b. an upper laterally aligned bracketing component and a lower laterally aligned bracketing component positioned at upper and lower portions of the screen door system, respectively, c. a handle movably positioned between the upper laterally aligned bracketing component and the lower laterally aligned bracketing component, the handle having an interior chamber housing extending in a substantially vertical direction, d. a pulley system having a first pulley member and a second pulley member where the first and the second pulley members are operatively configured to change in distance therebetween to be in closer proximity to one another in a substantially vertical direction within the interior chamber housing where a force is required for positioning the first and the second pulley members together, e. a balancing cord having a first end and a second end and a medial region, the medial region being adapted to extend around the first pulley member and the second pulley member where repositioning the handle of the screen door system to a closed screen configuration repositions the first pulley member and the second pulley member to a location closer to one another within the interior chamber of the screen dispenser and repositioning the handle of the screen door system to an open screen configuration, wherein the first pulley member is attached to a biasing member and the biasing member comprises a constant wind-up spool having a non-linear diameter where in the last portion of extension of the wind-up spool, the diameter substantially decreases to increase the amount of force upon the first pulley member.

2. The screen door system as recited in claim 1 where the first and the second ends of the balancing cord can each have a locking end that are adapted to be received within a plurality of distal end portions positioned on the upper and lower laterally aligned bracketing components.

3. The screen door system as recited in claim 1 where the handle has upper and lower edge portions that are adapted to extend within the upper and lower laterally aligned bracketing components respectively.

4. A method of installing a screen door on a door frame having first and second lateral regions and lower and upper perimeter regions, the method comprising:

a. rigidly attaching a base frame unit to the first lateral region of the door frame, wherein the base frame unit comprises a substantially vertically oriented base housing, b. attaching an upper laterally extending member and a lower laterally extending member to the upper and lower perimeter region of the door frame, the upper and lower laterally extending members having distal ends that oppose the portions of the upper and lower laterally extending members that are connected to the base frame unit, c. positioning a handle to be slideably attached to travel between the upper and lower laterally extending members, d. providing a screen positioned within the base housing where the screen is retractably withdrawn from a screen extension system contained within the base housing, e. attaching a first vertically extending end of the screen to the handle, the handle comprising an interior chamber that houses a cord retraction system, the cord retraction system comprising:

i. a cord member having an upper cord portion and a lower cord portion each respectively having upper and lower cord ends that retractable extend in a first lateral direction to the upper and lower portions of the handle respectively, the upper and lower cord ends having end locks adapted to be housed within base holder surfaces which are located in the upper and lower portions of the handle, f. repositioning the handle to a fully extended configuration whereby the upper and lower end locks of the upper and lower cords are received by an upper and lower locking mechanisms positioned at the laterally distal ends of the upper and lower laterally extending members, g. thereafter retracting the handle toward the base housing where the end locks of the upper an lower cords are now statically positioned at the distal end portions of the upper and lower laterally extending members.

5. The method of installing a screen door as recited in 4 where the base holding surface is a partially spherical surface which is adapted to receive a rearward male spherical surfaced portion of the end lock where the tension in the upper and lower balancing cords positions the rearward male spherical portion of the end lock within the spherical portion of the base holding portion of the upper and lower handle portions of the handle.

* * * * *